US006559749B1

(12) United States Patent
Weiner

(10) Patent No.: US 6,559,749 B1
(45) Date of Patent: May 6, 2003

(54) COIL FORMER

(76) Inventor: Peter Weiner, Am Aggerberg24, D51580 Reichshof (DE)

( * ) Notice: Subject to any disclaimer, the term of this patent is extended or adjusted under 35 U.S.C. 154(b) by 0 days.

(21) Appl. No.: 08/726,515

(22) Filed: Oct. 7, 1996

(30) Foreign Application Priority Data

Nov. 7, 1995 (DE) ..... 195 41 447

(51) Int. Cl.[7] ..... H01F 27/29
(52) U.S. Cl. ..... 336/192; 336/198; 336/208
(58) Field of Search ..... 336/192, 208, 336/198, 83

(56) References Cited

U.S. PATENT DOCUMENTS

| | | | | |
|---|---|---|---|---|
| 3,781,741 A | * | 12/1973 | Weiner | 336/198 |
| 4,353,051 A | * | 10/1982 | Wille et al. | 336/208 |
| 4,549,158 A | * | 10/1985 | Mitsui et al. | 336/83 |
| 4,890,085 A | * | 12/1989 | Saito et al. | 336/83 |
| 5,008,644 A | * | 4/1991 | Cooper | 336/192 |
| 5,521,574 A | * | 5/1996 | Lebschy et al. | 336/192 |

FOREIGN PATENT DOCUMENTS

| | | | | |
|---|---|---|---|---|
| DK | 51628 | * | 4/1936 | 336/192 |
| GB | 1034799 | * | 7/1966 | 336/192 |
| JP | 62-18016 | * | 1/1987 | 336/206 |
| JP | 63-29916 | * | 2/1988 | 336/192 |

* cited by examiner

*Primary Examiner*—Anh Mai
(74) *Attorney, Agent, or Firm*—Howard & Howard

(57) ABSTRACT

A coil former has an opening for accommodating a core consisting of two shells. The coil former has a winding body with flanges formed at both ends. At least one of the flanges has a connecting ledge extending in a transverse direction relative to a longitudinal axis of the opening. The connecting ledge has at least three soldering terminals arranged side-by-side for receiving winding wires. The soldering terminals are disclosed as cylindrical pins embedded in bases in a plane transverse to the longitudinal axis. These pins extend vertically from the bases. The bases are spaced apart from one another, and each have a rounded surface on a side facing an associated pin.

7 Claims, 2 Drawing Sheets

COIL FORMER

BACKGROUND OF THE INVENTION

The present invention relates to a coil former having an opening extending therethrough for accommodating a core consisting of two shells. The coil former has a winding body with flanges formed on both ends. At least one of the flanges has a connecting ledge extending in the transverse direction relative to the longitudinal axis of the opening. The connecting ledge has at least three soldering terminals arranged side by side for receiving winding wires wound about the winding body.

A known coil former of the above mentioned type has soldering terminals. The terminals are designed as soldering tags and have a substantially rectangular flat cross-section, wherein the width of the cross-section is substantially larger than its height. The ends of winding wires forming the windings on the winding body are wound about the soldering tags. The winding wires are then fixed to the soldering tags by soldering. Because of the high soldering temperature and subsequent cooling, changes in the length of the winding wire occur during this soldering process. These changes in length increase the tensile stress within the winding wire. This may impair the soldering quality and may cause the winding wire to be damaged or torn off during operation under varying work temperatures. Further, with the known coil former, using an automatic winding machine for winding the winding wire about a soldering tag is laborious. This is true since the path along which the winding wire is guided from the winding body to the soldering tag is complicated and the winding wire may be torn off at the edges of the soldering tags if it is pulled tightly.

SUMMARY OF THE INVENTION

It is the object of this invention to provide a coil former which permits simple automatic winding and which operates reliably.

This object is solved for a coil former of the above-mentioned type by providing soldering terminals in the form of essentially cylindrical pins embedded into bases such that they protrude vertically from the bases. The bases are spaced apart from one another, and each base has a rounded surface turned towards its associated pin. Each base supports a deflecting means for deflecting the winding wire before it is wound about the pin.

According to the invention, the soldering terminals are designed as essentially cylindrical pins. The cylindrical shape of the pins makes it possible to tightly wind the end of a winding wire about the pin, without any risk of tearing off the winding wire on sharp edges. The pins are embedded into bases which are spaced apart from one another and have a rounded surface. The winding wire can thus easily be supplied to the pin since the wire smoothly slides across the base and does not become entangled even if the coil former has a wrong orientation relative to a winding device. Further, according to the invention a deflecting means is provided for deflecting the winding wire before winding it about the pin. The deflecting means provides strain relief for the winding wire, to compensate for tensile stresses occurring during soldering.

Preferably, the deflecting means is designed as a deflecting peg, extending from the base radially relative to the coil former. This arrangement makes it possible to optimize the movement sequence of the winding device and the coil former relative to each other in a numerically controlled winding machine, since it is sufficient to effect pivotal movements by 90°. By using a cylindrical deflecting peg, the risk of tearing off the winding wire is reduced even if the winding wire is pulled tightly.

According to an embodiment of the invention, the connecting ledge, on the side facing towards the winding body, supports a wall extending in the longitudinal direction of the coil former. The wall is arranged at a predetermined distance from the bases, thereby creating a space through which the winding wire or winding wires are guided. These measures provide a guiding path for the winding wire or winding wires which ensures that the ends of the winding wires are supplied to the pins without crossing each other.

According to another embodiment of the invention, the wall has a vertically extending spacer. The end of the spacer extends beyond the height of the winding wire wound onto the pin. The spacer establishes a predetermined spacing from the printed board. This ensures that the end of the winding wire wound onto the pin and connected thereto by soldering is arranged at a sufficient distance from through holes in the printed board, to prevent faulty soldering as a result of covered through holes.

BRIEF DESCRIPTION OF THE DRAWINGS

An embodiment of the invention is described in the following on the basis of the accompanying drawings, wherein.

DETAILED DESCRIPTION OF A PREFERRED EMBODIMENT

Figure 1:
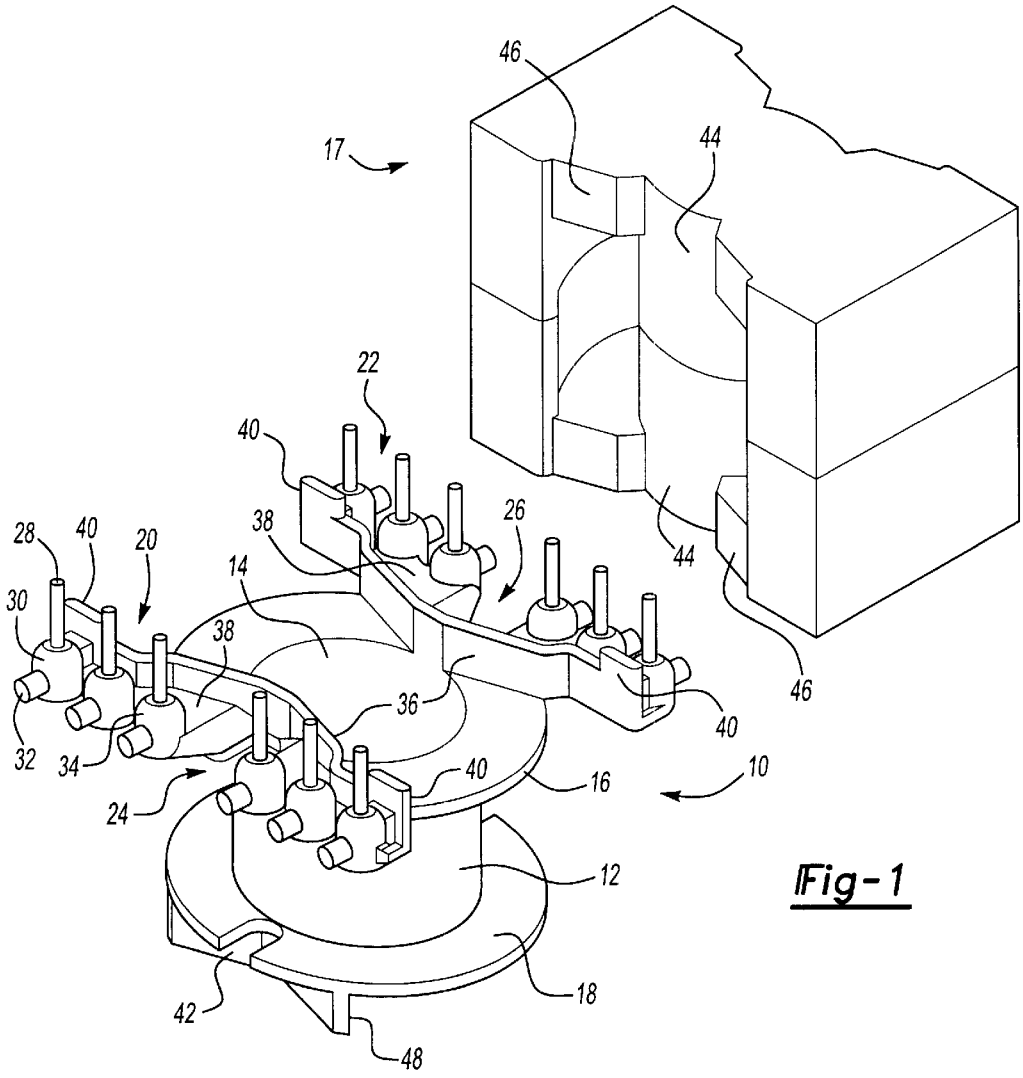
FIG. 1 is a perspective view of the new coil former and a perspective view of a ferrite core.

FIG. 1 is a perspective view of an embodiment of the coil former 10 of the invention. The coil former 10 has a winding body 12 having an opening 14 extending therethrough for accommodating a two-shell core 17 shown in the upper portion of the figure. At each end of the winding body 12, there is formed a flange 16, 18, which constitutes a lateral boundary for the windings (not shown) on the winding body 12.

The upper flange 16 supports two connecting ledges 20, 22 which have central segment-like recesses 24 and 26, respectively. The connecting ledges 20, 22 support pins 28. For the sake of clarity, only one of these pins is identified by the reference number 28. On each connecting ledge 20, 22, the pins 28 are aligned along a straight line and have a substantially cylindrical shape. The pins 28 are embedded in bases 30, only one of which is identified by the reference number 30. A deflecting peg 32 of an essentially cylindrical shape extends from each base 30 in a direction approximately perpendicular to the longitudinal axis of the corresponding connecting ledge 20, 22 and perpendicular to the axis of the pin 28. Each base 30 has a rounded surface 34 on its upper side facing the pin 28.

On the side facing the winding body 12, each connecting ledge 20, 22 supports a wall 36 extending in the longitudinal direction of the coil former 10 and spaced by a predetermined distance from the bases 30. This creates a guiding path 38 along which the winding wires are guided to the associated pins 28.

Each wall 36 carries spacers 40 which establish a predefined spacing relative to a printed board (not shown). The height of each spacer 40 is such that a winding wire wound about the pin 28 as well as the associated solder have a sufficient distance from the printed board to ensure that neither the end of the winding wire nor the solder clot obstruct the through hole in the printed board into which the pin 28 is inserted. Faulty soldering is thus prevented.

The two flanges 16, 18 each have a guiding recess 42 (only the lower guiding recess 42 is visible) for a winding spindle of the winding machine. This guiding recess thus defines the positional relationship between the coil former 10 and the winding machine.

The two-shell core 17 shown in the upper portion of the figure has a central column portion 44 which fits into the opening 14 of the winding body 12. The outer shape of the magnetic core 17 is such that the upper and lower portions 46 are essentially flush with the inner surfaces of the connecting ledges 20, 22 and with stop surfaces 48, respectively.

Figure 2:
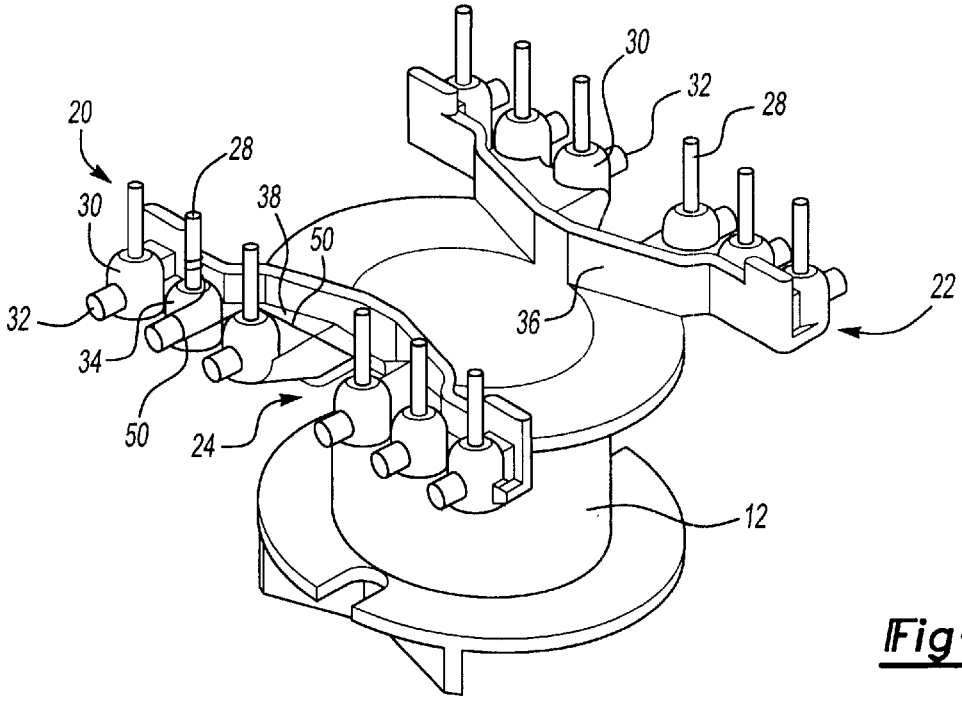
FIG. 2 is a view of the coil former with the end of a winding wire wound about a pin.

FIG. 2 schematically shows the path of a winding wire 50 from the winding body 12 to the pin 28. The winding wire 50 passes through the recess 24 and follows the guiding path 38. Passing between two bases 30, the wire is brought to the front and deflected about the deflecting peg 32. Then, the winding wire 50 runs to the bottom of the pin 28, wherein it is in contact with the rounded portion 34. The winding wire 50 is then wound about the pin 28. By deflecting the winding wire about the deflecting peg 32, strain relief is provided so that even if the winding wire is pulled tightly, the risk of damaging or tearing off the winding wire is reduced. The rounded portion 34 prevents the winding wire 50 from becoming entangled.

Figure 3:
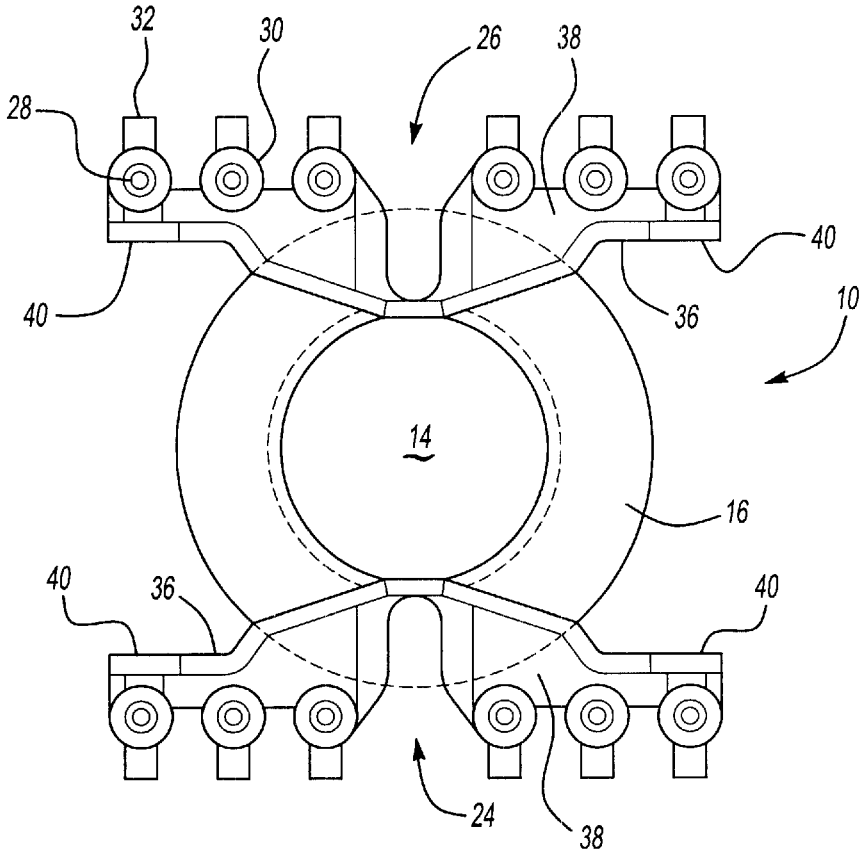
FIG. 3 is a plan view of the coil former of FIG. 1.

FIG. 3 is a plan view of the coil former 10 of FIG. 1 and gives a better illustration of parts that are not fully visible in FIG. 1. Like parts are identified by like reference numbers.

The pins 28 of the two connecting ledges extend in planes that are parallel to the longitudinal axis of the coil former 10. All pins point into the same direction. It is thus possible to connect the ends of the winding wires wound on the pins 28 with all the pins in a single soldering process, e.g. by means of dip soldering.

Further details about the design of the pins 28 are disclosed in German Utility Model No. 295 12 324.9, the disclosure of which is incorporated herein.

What is claimed is:

1. A coil former having an opening extending there through for accommodating a two-shell core comprising:

said coil former having a winding body with flanges formed on both ends;

a connecting ledge extending in a transverse direction relative to the longitudinal axis of the opening formed on at least one said flange;

said connecting ledge having at least three soldering terminals arranged side by side for receiving winding wires wound about said winding body, said connecting ledge also supporting a wall extending from a side of said connecting ledge facing said winding body, said wall extending from said connecting ledge at the same side as said terminals, and extending in a longitudinal direction of said coil former, and spaced by a predetermined distance from said bases, thereby creating a space through which a winding wire may be guided.

2. A coil former according to claim 1, wherein said deflecting means is a deflecting peg extending from said base perpendicularly relative to said connecting ledge, and that said deflecting peg is cylindrical.

3. A coil former according to claim 1, wherein said wall supports a vertically extending spacer, an end of said spacer extending beyond the height of the winding wire wound about said pin or the height of the solder material.

4. A coil former according to claim 1, wherein each of said flanges has at least one recess in the form of a sector, and that the winding wires are guided to said pins through said recess.

5. A coil former according to claim 1, wherein at least one said flange has a guiding recess for a winding spindle of a winding machine.

6. A coil former comprising:

a body with an opening extending through said body, and adapted to accommodate a two-shell core;

said coil former having a winding body with flanges formed at opposed ends;

a connecting ledge extending in a transverse direction relative to a longitudinal axis of said opening, and formed on at least one said flange, said connecting ledge having at least three soldering terminals arranged side-by-side for receiving winding wires wound about said winding body, said connecting ledge also supporting a wall extending from a side of said connecting ledge facing said winding body, said wall extending from said connecting ledge at the same side as said terminals, and extending in a longitudinal direction of said coil former, and spaced by a predetermined distance from said terminals, thereby creating a space through which a winding wire may be guided.

7. A coil former as recited in claim 6, wherein said deflector member is a peg extending from said base perpendicular relative to said connecting ledge, and said deflecting peg being cylindrical.

* * * * *

UNITED STATES PATENT AND TRADEMARK OFFICE

CERTIFICATE OF CORRECTION

PATENT NO. : 6,559,749 B1
DATED : June 17, 2003
INVENTOR(S) : Peter Weiner

It is certified that error appears in the above-identified patent and that said Letters Patent is hereby corrected as shown below:

Column 4,
Lines 10 and 43, delete ".", insert -- ; and --
Line 11, insert the following paragraph in claim 1 before claim 2:
-- said soldering terminals being essentially cylindrical pins embedded in bases in a plane transverse to the longitudinal axis, and extending vertically from said bases, said bases being spaced apart from one another, and each of said bases having a rounded surface on a side facing an associated pin which carries a deflecting means about which the winding wire is deflected before being wound about said pin. --
Line 44, insert the following paragraph in claim 6 before claim 7:
-- said soldering terminals being essentially cylindrical pins embedded in bases and a plane transverse to said longitudinal axis; said pins extending vertically from said bases, said bases being spaced from one another and said each of said bases having a rounded surface on a side facing an associated pin which carries a deflector member. --

Signed and Sealed this

Thirtieth Day of September, 2003

JAMES E. ROGAN
*Director of the United States Patent and Trademark Office*